US007465897B2

(12) United States Patent
Horton

(10) Patent No.: US 7,465,897 B2
(45) Date of Patent: Dec. 16, 2008

(54) ROTARY CIRCUIT SELECTION DEVICE WITH CROWN DETENT

(75) Inventor: Donald L. Horton, deceased, late of Canoga Park CA (US); by Pamela A. Horton, legal representative, Canoga Park, CA (US)

(73) Assignee: Emrise Corporation, Rancho Cucamonga, CA (US)

( * ) Notice: Subject to any disclaimer, the term of this patent is extended or adjusted under 35 U.S.C. 154(b) by 0 days.

(21) Appl. No.: 10/581,240

(22) PCT Filed: Oct. 5, 2004

(86) PCT No.: PCT/US2004/032797

§ 371 (c)(1),
(2), (4) Date: May 1, 2007

(87) PCT Pub. No.: WO2006/041468

PCT Pub. Date: Apr. 20, 2006

(65) Prior Publication Data

US 2007/0289856 A1 Dec. 20, 2007

(51) Int. Cl.
*H01H 19/14* (2006.01)

(52) U.S. Cl. ..... 200/564; 200/565

(58) Field of Classification Search ..... 200/564–571, 200/336; 341/35; 345/184
See application file for complete search history.

(56) References Cited

U.S. PATENT DOCUMENTS

| | | | | |
|---|---|---|---|---|
| 3,193,653 | A * | 7/1965 | Cope | 200/330 |
| 3,903,383 | A * | 9/1975 | Marker | 200/11 TW |
| 3,999,021 | A * | 12/1976 | Delp | 200/11 DA |
| 4,059,738 | A | 11/1977 | Mongeau | |
| 4,107,482 | A * | 8/1978 | Marker | 200/6 B |
| 6,617,534 | B2 | 9/2003 | Goff et al. | |
| 6,849,818 | B2 * | 2/2005 | Koide et al. | 200/564 |
| 7,094,982 | B2 * | 8/2006 | Liu | 200/336 |

* cited by examiner

*Primary Examiner*—Michael A Friedhofer
(74) *Attorney, Agent, or Firm*—Hani Z. Sayed; Rutan & Tucker, LLP

(57) ABSTRACT

A rotary circuit selection device (400) having a driving cam (430) and an operating cam (440), each having a series of alternating peaks (442) and valleys (455). A biasing mechanism (420) biases the driving cam toward the stationary cam such that the peaks of one cam are received by the valleys of the other cam and vice versa. Selection of an alternative circuit includes rotating and translating the driving cam in relation to stationary cam.

19 Claims, 1 Drawing Sheet

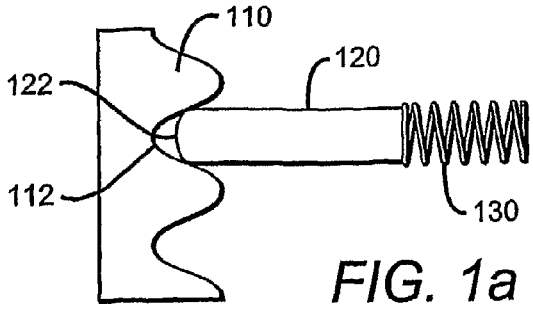
FIG. 1a
PRIOR ART
FIG. 1b
PRIOR ART
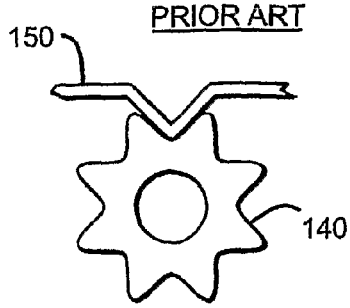
FIG. 3
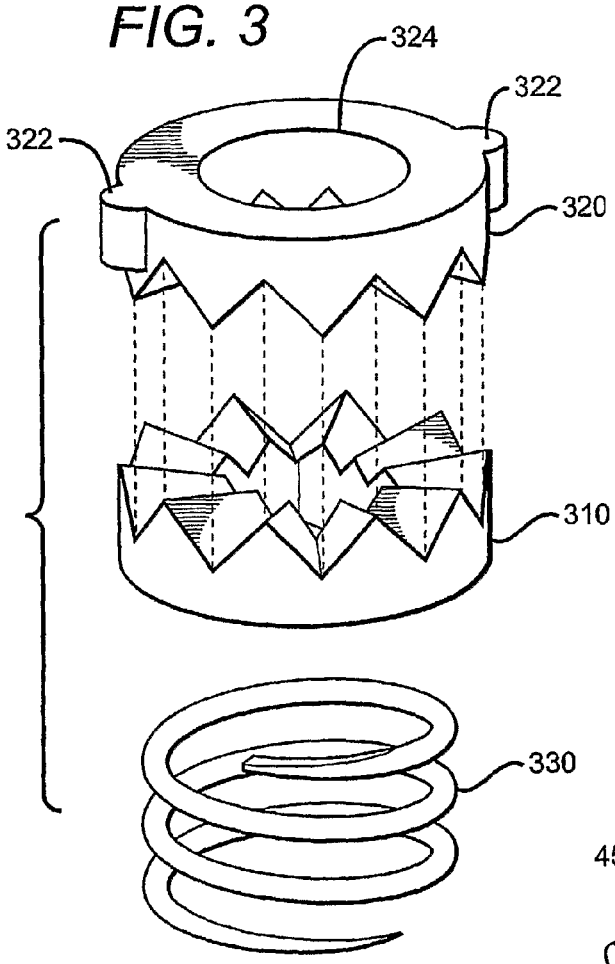
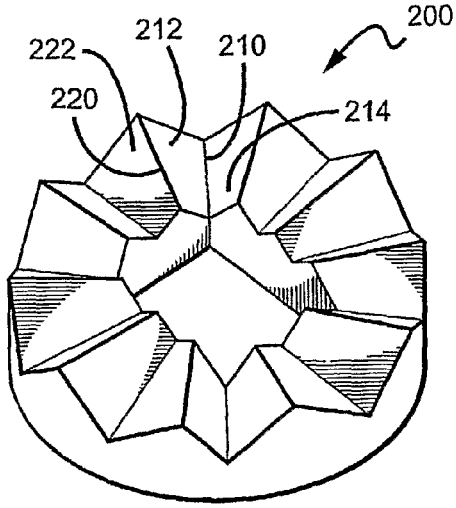
FIG. 2
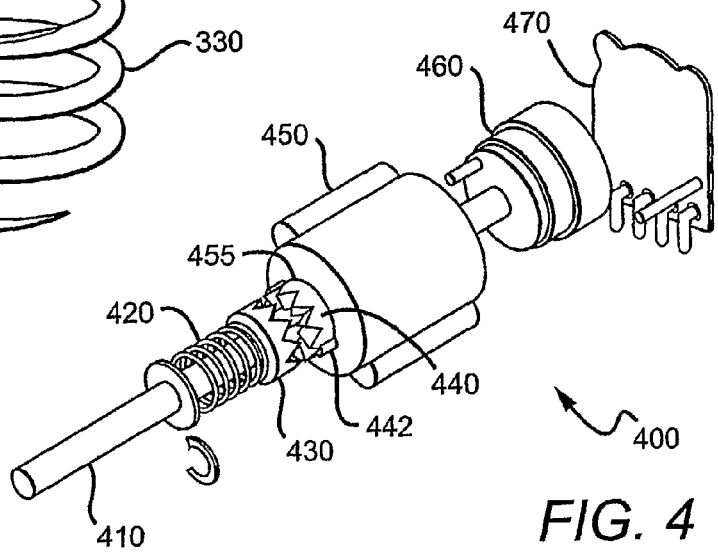
FIG. 4

ROTARY CIRCUIT SELECTION DEVICE WITH CROWN DETENT

FIELD OF THE INVENTION

The field of the invention is electromechanical switches.

BACKGROUND OF THE INVENTION

A rotary circuit selection device generally uses a rotating shaft connected to a terminal to make or break a connection to one or more other terminals. In performing its function, a rotary switch also uses a detent mechanism. Merriam-Webster's Online Dictionary defines a detent as "a device (as a catch, dog, or spring-operated ball) for positioning and holding one mechanical part in relation to another so that the device can be released by force applied to one of the parts". Basically, the detent aids a user of the switch in establishing and holding a knob position that equates to a desired electrical setting.

In order to set and hold a particular position, a detent often comprises a cam follower and a cam. The cam is generally an annular component with a hole in the middle. The surface of the cam that forms the hole is varied in contour. As a shaft is rotated a cam follower travels along the contour of the cam becoming seated and unseated in turn. Each seated position generally equates to a particular electrical setting while an unseated position is generally between circuits. This type of cam/cam follower configuration is particularly well illustrated in U.S. Pat. No. 6,617,534 issued to Goff et al. in September 2003. A problem with this type of detent, however, is that the size of the spring biasing the cam follower is dependent upon the size of the cam follower shaft. This is important because the amount of torque required to rotate the cam follower is related to the spring tension.

U.S. Pat. No. 4,059,738 issued to Mongeau in November of 1977 shows a another type of detent. The detent of the '738 patent has a cam follower that follows the outside contour of the cam rather than the inside contour. In any case, the cam has alternating raised and lowered portions that form seats for the cam follower. As with most detents, however, use of the switch causes both the cam and the cam follower to wear in a manner that causes play (i.e. movement when the cam follower is in a seated configuration) in the switch. Excessive play in the switch is undesirable because it can cause a circuit to be inadvertently opened or closed.

Thus, there is a need for methods and devices which can use higher tension springs and which do not become less accurate due to use.

SUMMARY OF THE INVENTION

The present invention is directed toward a rotary circuit selection device having a driving cam and an opposing stationary cam. The cams each have a series of alternating peaks and valleys adapted to inhibit and reduce play over time. A biasing mechanism biases the driving cam toward the stationary cam such that, in a seated position, the peaks of one cam are received by the valleys of the other cam and vice versa (i.e. the valleys of the one cam receive the peaks of the other cam). In order to select a circuit, a shaft rotates and translates the driving cam in relation to the stationary cam.

Another aspect of the invention includes methods of changing a circuit (i.e. indexing) comprising the following steps: providing a driving cam and opposing stationary cam; selecting a first circuit by aligning particular peaks with particular valleys; and subsequently selecting a second circuit by torquing the driving cam relative to the stationary cam in order to align other peaks with other valleys.

Various objects, features, aspects and advantages of the present invention will become more apparent from the following detailed description of preferred embodiments of the invention, along with the accompanying drawings in which like numerals represent like components.

BRIEF DESCRIPTION OF THE DRAWING

FIG. 1*a* is a side view of a prior art detent mechanism.

FIG. 1*b* is a schematic of an alternative prior art detent mechanism.

FIG. 2 is perspective view of an annular cam.

FIG. 3 is a perspective view of a detent assembly.

FIG. 4 is an exploded view of a rotary switch with a crown detent.

DETAILED DESCRIPTION

FIGS. 1*a* and 1*b* are examples prior art detent mechanisms. The detent mechanism of FIG. 1*a* comprises a cam 110, a cam follower 120, and a spring 130. In operation, cam follower 120 will follow the contour of cam 110 as the cam is rotated. It should be recognized that the cam follower will cause wear in the peaks and valleys of the cam as it moves over those areas. Additionally, it can be observed that the tip of the cam follower 122 will not contact the valley 112 until substantial wear has occurred. Wear causes relatively more play in a detent mechanism, however, causing it to become less accurate over time and eventually making it unsuitable for its intended purpose.

FIG. 1*b* is an alternative prior art detent having a cam 140 and a cam follower 150. Here, the cam follower 150 follows the outside contour of the cam 140 as the cam rotates. Again, however, wear will cause additional play in the switch rendering it less accurate over time.

FIG. 2 is an annular cam 200 in accordance with the inventive subject matter. The annular cam 200 has a series of alternating peaks (e.g. 210) and valleys (e.g. 220) formed by converging sides. Peak 210 has an angle formed by converging sides 212 and 214 and valley 220 has an angle formed by converging sides 222 and 212. In preferred embodiments, converging sides meet at a discrete line (a peak or a valley) and such peaks and valleys are radially spaced along the entire circumference of the annular cam. Angles that are formed by any two converging sides are substantially equal. These substantially equal angles facilitate firm seating of a peak in a valley. The firm seating of a peak in a valley is further characterized by substantial contact of peaks and valleys as well as substantial contact of converging sides. Substantial contact is envisaged to encompass contact over 75% of the surface area of the peaks, valleys, and converging sides.

Cam 200 is made from steel, however, many other constituent materials are contemplated including other metals, metal composites, hard thermoplastics, and so on. Particularly preferred materials are those that have a low coefficient of friction including silicon nitride ($Si_3N_4$).

Cam 200 has 10 peaks and 10 valleys and therefore can support up to 10 different circuits. Other configurations can have more or less peaks, valleys, and circuits with the only limitation being that opposing cams have the same number of peaks and valleys.

FIG. 3 depicts the interrelationship between a driving cam 310 and a stationary cam 320 with dash lines indicating the alignment of peaks and valleys in a seated configuration. Driving cam 310 "matches" stationary cam 320 in that peaks and valleys of one are inverted equivalents to valleys and peaks of the other. By providing substantially equally sized and angled peaks and valleys around the entire circumference of both cams, the cams not only remain firmly seated over time but they become more accurate because high spots get worn to the point of equivalence. Moreover, the serrated gear configuration distributes wear over a relatively larger area thereby increasing useful life.

Driving cam 310 both rotates and translates while stationary cam 320 does not rotate or translate. The driving cam 310 is provided with a square interior aperture (not shown) so that the shaft (not shown) can rotate the driving cam 310. One of skill in the art will recognize, however, that a square aperture is not required in order for the shaft to rotate the driving cam as other known means of accomplishing this functionality can be employed.

For purposes of this specification, a cam is a generally annular component having a contour of equally spaced and dimensioned peaks and valleys. As one cam rotates in relation to the other, there is both circular and linear motion. For instance, the driving cam rotates in circular motion as it translates in linear motion on a shaft.

Translation of the driving cam 310 about the shaft is as least partly aided by a compression spring 330. A compression spring or other biasing mechanism (e.g. other types of springs, torsion bars, and so on) biases the driving cam toward the stationary cam. In a seated configuration, the biasing mechanism biases all of the peaks of one cam into all of the valleys of the other cam. However, as the driving cam is rotated, the spring also allows translation of the driving mechanism away from the stationary mechanism.

In FIG. 3, the spring has an outer diameter that is approximately equal to that of the driving cam, however, in other embodiments, the biasing mechanism can have a diameter more or less than that of the driving cam. In those embodiments where the diameter is greater than the driving cam, it may be advantageous to insert a washer between the spring and the driving cam. It should be noted that the amount of torque required to rotate the shaft is at least partly based on the amount of force exerted by the biasing mechanism. Thus, a large diameter spring may produce relatively more force and therefore require relatively more rotational torque. This contributes to the feel or stiffness of the switch.

Stationary cam 320 has a circular aperture 324 so that it does not rotate along with the shaft. One other significant difference between the driving cam 310 and the stationary cam 320 is that the stationary cam has tabs 322 which cooperate with a bushing (not shown here) to inhibit rotational movement of the stationary cam 320. Means of inhibiting rotational movement of the stationary cam is discussed below with reference to FIG. 4.

Drawing your attention now to FIG. 4, an exploded rotary switch 400 generally comprises a shaft 410, a compression spring 420, a driving cam 430, a stationary cam 440, a bushing 450, a brush holder 460, and a printed circuit board (PCB) 470.

Shaft 410 generally extends above and below a control panel and couples to a knob (not shown) above the panel and to a set of wipers (not shown) below the panel. Shaft 110 is comprised of a metal alloy but any sufficiently strong material will suffice so long as it is capable of performing the functions described herein. As depicted in the figure, the shaft is preferably adapted to extend through the driving cam 430, the stationary cam 440, and the bushing 450 terminating at the brush holder 460. A notable function of the shaft is to effect a rotational alignment between the knob and the electrical contacts (e.g. wipers or brushes). It should be pointed out that a functionally suitable shaft may have various cross, sectional shapes along its length. That is, shaft 410 has a square cross section at the point where it extends through the driving cam 430 yet it has a circular cross section at the point where it extends through the stationary cam 440.

Shaft 410 extends to and couples with a brush holder 460 which rotates in order to align an electrical contact with a conductive trace on PCB 470. One of skill in the art will recognize that the inventive subject matter is not limited to electrical circuits and that the term "circuit" should be interpreted as broadly as possible while still remaining within the overall inventive concept. As an example, in alternative embodiments an optical circuit can formed by providing a path from an optical source to an optical sensor. A further example is a magnetic circuit wherein a magnetic source forms a circuit with a magnetic receiver.

It is contemplated that a stationary cam will be inhibited from movement based on its placement into a bushing. Stationary cam seats into a depression 455 in bushing 450. It can be seen that stationary cam 440 has at least one tab 442 that cooperates with the bushing 450 to inhibit the stationary cam 450 from rotation. In other embodiments, the stationary cam can be inhibited from rotational movement by other means including installation of a stop screw.

The inventive concept herein also comprises methods of changing a circuit including the steps of providing the cams, selecting a first circuit, and selecting a second circuit. More particularly, the step of selecting a first circuit includes aligning particular peaks with particular valleys while the step of selecting a second circuit is accomplished by torquing the driving cam relative to the stationary cam in order to align (and seat) other peaks and other valleys. For an established first circuit, the driving cam is biased toward the stationary cam. However, the step of selecting the second circuit includes the driving cam being rotated while first translating away from the stationary cam then back toward the stationary cam until seated.

Thus, specific embodiments and applications of a rotary circuit selection device have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A rotary circuit selection device, comprising:

a driving cam and an opposing stationary cam each having a series of alternating peaks and valleys and further wherein the driving cam and the opposing stationary cam have peaks wherein the peaks and valleys have angles formed by converging sides having angles that are substantially equal;

a biasing mechanism configured to bias the driving cam toward the stationary cam such that the peaks of each cam are received by the valleys of the opposing cam;

the peaks and valleys of the cams extending towards each other along a translational direction of motion of the driving cam; and a shaft that rotates and translates the driving cam in relation to the stationary cam in order to select the circuit.

2. The device of claim 1, wherein the circuit comprises electrical components.

3. The device of claim 1, wherein the circuit comprises optical components.

4. The device of claim 1, wherein the circuit comprises magnetic components.

5. The switch of claim 1, wherein each peak has an angle formed by converging sides of the peak and each valley has an angle formed by converging sides of the valley, and wherein the angles of the peaks and the angles of the valleys are substantially equal.

6. The switch of claim 1, wherein the biasing mechanism is a compression spring.

7. The switch of claim 6, wherein the spring has an outer diameter less than an outer diameter of the driving cam.

8. The switch of claim 6, wherein the spring has an outer diameter greater than an outer diameter of the driving cam.

9. The switch of claim 8, further comprising a washer disposed between the spring and the driving cam.

10. The switch of claim 1, wherein each cam has 8 peaks and 8 valleys.

11. The switch of claim 1, wherein each cam has 10 peaks and 10 valleys.

12. The switch of claim 1, wherein the shaft extends through inner apertures of each cam.

13. The switch of claim 1, wherein an amount of torque required to rotate the shaft is at least partly based on an amount of force of the biasing mechanism.

14. A method of changing a circuit, the method comprising the steps of:

providing a driving cam and an opposing stationary cam, the driving cam rotating about an axis, and each of the cams having a body and a plurality of alternating peaks and valleys that extend outward from the respective bodies parallel to the axis and further wherein the peaks and valleys are radially spaced along the entire circumference of the driving cam and the opposing stationary cam;

selecting a first circuit by aligning particular peaks with particular valleys; and subsequently selecting a second circuit by torquing the driving cam relative to the stationary cam in order to align other peaks with other valleys.

15. The method of claim 14, wherein the step of selecting a first circuit further comprises a step of biasing the driving cam toward the stationary cam.

16. The method of claim 14, wherein the step of torquing the driving cam causes the driving cam to translate between a received configuration and a distal configuration.

17. The method of claim 14, wherein the step of selecting a second circuit further comprises a step of aligning an electrical contact with a trace on a printed circuit board.

18. The method of claim 14, wherein the step of selecting a second circuit further comprises a step of providing a path from an optical source to an optical sensor.

19. The method of claim 14, wherein the step of selecting a second circuit further comprises a step of aligning a magnetic source with a magnetic receiver.

* * * * *